US005229353A

United States Patent [19]

Vanmaele et al.

[11] Patent Number: 5,229,353

[45] Date of Patent: Jul. 20, 1993

[54] THERMAL TRANSFER PRINTING WITH ULTRA-VIOLET ABSORBING COMPOUND

[75] Inventors: Luc J. Vanmaele, Lochristi; Wilhelmus Janssens, Langdorp, both of Belgium

[73] Assignee: AGFA-Gevaert, N.V., Mortsel, Belgium

[21] Appl. No.: 713,846

[22] Filed: Jun. 12, 1991

[30] Foreign Application Priority Data

Jul. 3, 1990 [EP] European Pat. Off. ..... 90201776.3

[51] Int. Cl.[5] ..... B41M 5/035; B41M 5/38

[52] U.S. Cl. ..... 503/227; 428/195; 428/484; 428/913; 428/914; 430/200; 430/945

[58] Field of Search ..... 8/471; 428/195, 913, 428/914, 484, 488.1, 488.4; 503/227; 430/200, 945

[56] References Cited

U.S. PATENT DOCUMENTS 4,876,237 10/1989 Byers et al. ..... 503/227

*Primary Examiner*—B. Hamilton Hess

*Attorney, Agent, or Firm*—Breiner & Breiner

[57] ABSTRACT

A thermal transfer printing process wherein a donor element for thermal transfer is heated imagewise in contact with a receptor element to transfer thereon a UV-absorbing compound, said donor element comprising a sheet, ribbon or web support having on one side thereof a layer incorporating in a wax or polymeric binder material an UV-absorbing benzthiazole compound corresponding to the following general formula (A):

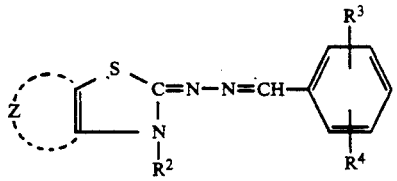

(A)

wherein:

Z represents the atoms necessary to close an unsubstituted or substituted adjacent aromatic ring or ring-system, $R^2$ represents hydrogen, an alkyl group of 1 to 4 carbon atoms, or a phenyl group, each of $R^3$ and $R^4$ (same or different) represents hydrogen, an amino group, a substituted amino group, an alkoxy group or a substituted alkoxy group.

16 Claims, No Drawings

THERMAL TRANSFER PRINTING WITH ULTRA-VIOLET ABSORBING COMPOUND

DESCRIPTION

1. Field of the Invention

This invention relates to a thermal transfer printing process and the use therein of a donor element to produce therewith a UV-absorbing image not fluorescing in the visible light spectrum.

2. Background of the Invention

Thermal dye transfer printing is a recording method wherein a dye-donor element is used that is provided with a dye layer wherefrom dyed portions or incorporated dye is transferred onto a contacting receiver element by the application of heat in a pattern normally controlled by electronic information signals.

According to one embodiment dye images are produced by thermal-ink transfer printing by selectively energizing the electrical resistors of a thermal head array in contact with a thin thermally stable resin base, which contains on its opposite side a so-called ink-layer from which a dye can be thermally transferred onto a receptor material.

According to another embodiment known as resistive ribbon non-impact printing [ref. e.g. Progress in Basic Principles of Imaging Systems-Proceedings of the International Congress of Photographic Science Köln (Cologne), 1986, editors: Friedrich Granzer and Erik Moisar, Friedr. Vieweg & Sohn-Braunschweig/Wiesbaden, Journal of Imaging Technology, Vol. 12, No. 2, April 1986, p. 100–110 and Journal of Imaging Science-Volume 33, No. 1, January/February 1989, p. 7) from an electrode-array electrical current is sent pixelwise into a resistive ribbon coated with a thermally transferable dye. According to a specific mode the resistive ribbon consists of a 16 um composite film of polycarbonate imbedded with electrically conductive carbon black and has a sheet resistance in the range of 500 to 900 ohms/square. The carbon loaded polycarbonate base is overcoated with a thin layer (100 nm) of aluminum having a naturally formed oxide layer of about 4 nm. On said aluminum layer a thermal dye transfer coating is applied which during printing is kept in contact with a paper sheet acting as dye receptor material. The interface resistance of the aluminium serves additionally to Joule heating which mainly occurs in the carbon loaded polycarbonate base and stems from a current pulse injected from a pixel-electrode that makes contact with said base.

According to still another embodiment known as laser-induced thermal dye transfer (ref. e.g. U.S. Pat. No. 4,876,235) a dye donor element is used which contains a thermally transferable dye and a finely divided substance that is heated by absorbing laser light. According to a particular embodiment an infrared emitting laser and a dye-donor element containing an infrared absorbing material is used as described e.g. in U.S. Pat. No. 4,912,083.

In said dry dye transfer processes heat is supplied pixelwise by modulated laser beam or energized electrodes. The image signals for modulating the laser beam or electrode energy are obtained directly e.g. from opto-electronic scanning devices or from an intermediary storage means, e.g. magnetic disc or tape or optical disc storage medium, optionally linked to a digital image work station wherein the image information can be processed to satisfy particular needs.

According to a more recently disclosed technique, see e.g. U.S. Pat. No. 4,908,631, an ultrasonic pixel printer is applied to a dye donor layer to cause the dye to melt and/or sublime and transfer to a receiver.

Thermal dye transfer processes are intended mainly for multicolour dye image reproduction but are not restricted to the transfer of substances absorbing in the visible spectrum. For example, said processes are applied likewise in thermal transfer of UV-absorbing fluorescent compounds as described e.g. in U.S. Pat. Nos. 4,876,234 and 4,891,351. These fluorescent compounds are used to obtain visible fluorescent light images by their exposure to ultraviolet light. Under normal viewing conditions the pattern of fluorescent compounds is invisible and may serve to include in documents such as ID-cards invisible confidential information that only by UV-exposure can made visible.

The use of thermally transferred UV-absorbing compounds is not only interesting in the production of non-visual ultraviolet absorbing images for identification purposes but is likewise of value in the prevention of photodegradation of thermal dye images the dyes of which are more or less sensitive to photodegradation by UV-radiation e.g. in the exposure to sunlight.

Furthermore it is possible to use imagewise heat-transferred UV-absorbing compounds as photographic masks serving as intermediary copies in the exposure of UV-sensitive recording materials, e.g. UV-sensitive photoresist materials suited for the production of lithographic (planographic) printing plates. For more details on the latter use reference is made to unpublished European Patent Application titled: "Production of halftone or linework patterns" filed on even date herewith. Especially for the last mentioned application it is important that the applied compounds are strongly UV-absorbing even at low coverage, in other words have high UV-extinction power.

"UV" stands for ultraviolet radiation.

SUMMARY OF THE INVENTION

It is an object of the present invention to provide a thermal transfer printing process wherein a donor element containing a UV-absorbing compound is used to produce therewith in a receptor element an invisible image having high UV-absorption power.

It is a further object of the present invention to provide a thermal transfer printing process wherein a donor element containing a UV-absorbing compound and a thermally transferable dye is used to produce therewith in a receptor element a dye image protected against photodegradation by UV-irradiation without change in colour by visible fluorescent light emitted by the UV-absorbing compound.

It is another object of the present invention to provide a donor element suited for use in a thermal printing process wherein said donor element contains a compound having high UV-extinction power.

Other objects and advantages of the present invention will appear from the further description and examples.

In accordance with the present invention a thermal transfer printing process is provided wherein a donor element for thermal transfer is heated imagewise in contact with a receptor element, said donor element comprising a sheet, including a ribbon or web, support having on one side thereof a layer incorporating in a wax or polymeric binder material an UV-absorbing benzthiazole compound corresponding to the following general formula (A):

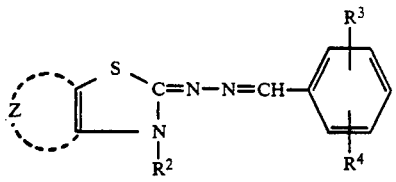

(A)

wherein:

Z represents the atoms necessary to close an unsubstituted or substituted adjacent aromatic ring or ring-system, e.g. an adjacent benzene ring either or not substituted with one or more substituents $R^1$ of the following group: alkyl, e.g. methyl, alkoxy, halogen, e.g. chlorine or bromine, and cyano, —COR, —$SO_2R$, —NHCOR, or —$NHSO_2R$, wherein R is alkyl, alkaryl or aryl; —$SO_2$—N($R^{11}$,$R^{12}$), wherein each of $R^{11}$ and $R^{12}$ (same or different) is hydrogen, alkyl, alkaryl or aryl, and —NHP(O)($R^{13}$,$R^{14}$), wherein each of $R^{13}$ and $R^{14}$ (same or different) is hydrogen, alkyl, alkaryl, aryl, alkoxy, amino or substituted amino, e.g. dialkylamino, $R^2$ represents hydrogen, an alkyl group of 1 to 4 carbon atoms, or an aryl group, e.g. phenyl group, each of $R^3$ and $R^4$ (same or different) represents hydrogen, an amino group, a substituted amino group, e.g. a dialkylamino group, an alkoxy group or a substituted alkoxy group.

Further in accordance with the present invention a donor element suited for use in a thermal printing process is provided, wherein said donor element comprises a support having on one side thereof in a binder medium a UV-absorbing compound according to the above general formula (A), and on the other side a slipping layer comprising a lubricant.

DETAILED DESCRIPTION OF THE INVENTION

Said benzthiazole compounds can be prepared according to methods given in U.S. Pat. No. 3,745,010, wherein said compounds have been described as starting materials for the production of UV-absorbing polymers.

UV-absorbing benzthiazole compounds according to the above general formula (A) that are particularly useful in the process of the present invention are listed in the following Table 1 with their absorption maximum (AM) expressed in nm, extinction coefficient (ε) expressed in $cm^{-1}.mol.^{-1}/l$ and melting point (MP) expressed in °C.

TABLE 1

| No. | Structural formula | AM nm | ε | MP °C. |
|---|---|---|---|---|
| 1. | 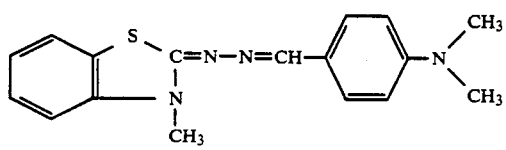 | 367 | 50629 | 170 |
| 2. | 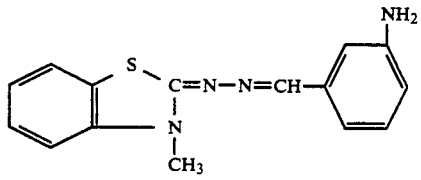 | 237<br>350 | 30620 | 169 |
| 3. | 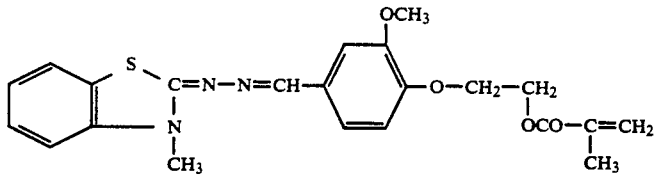 | 351 | 37323 | 134 |
| 4. | 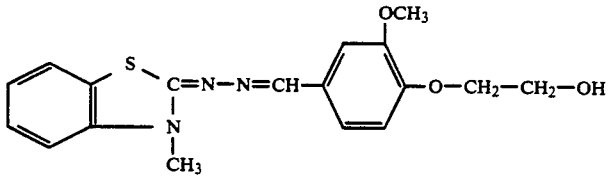 | 351 | 36122 | 190 |
| 5. | 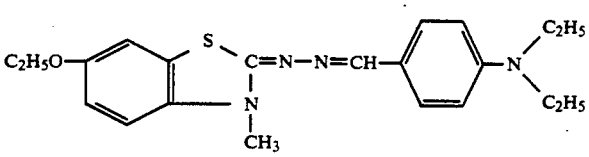 | 372 | 51951 | 123 |

The heat-sensitive recording material suited for heat-induced (thermal) transfer of the UV-absorbing compound(s) is formed preferably by adding the UV-absorbing compound(s), the polymeric binder medium, and other optional components to a suitable solvent or solvent mixture, dissolving or dispersing the ingredients to form a coating composition that is applied to a support, which may have been provided first with an adhesive or subbing layer, and dried.

The heat-sensitive layer thus formed has a thickness of about 0.2 to 5.0 μm, preferably 0.4 to 2.0 μm, and the amount ratio of UV-absorbing compound to binder is between 9:1 and 1:3 by weight, preferably between 2:1 and 1:2 by weight.

As polymeric binder the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic, and likewise modified natural binders such as modified dextrans described in unpublished European Patent Application No. 90200481.1.

The thermal transfer of the UV-absorbing compound may be improved by its use in conjunction with a thermal solvent. Thermal solvents are non-hydrolyzable organic compounds that are solid at ambient temperature (20°-25° C.) but liquid at elevated temperature. Preferably they have a melting point between 40° C. and 300° C., more preferably between 40° and 150° C. In fused state they act as a solvent for the UV-absorbing compound(s) to be transferred. Examples of thermal solvents have been described in U.S. Pat. Nos. 3,347,675, 3,438,776, 3,667,959 and 4,740,446, published EP-A 0 119 615 and 0 122 512 and DE-A 3 339 810. Further such solvents are described in Research Disclosure (December 1976), item 15027 for use in photothermographic methods and materials containing light sensitive silver salts.

Together with the UV-absorbing compound(s) any dye absorbing in the visible spectrum may be transferred thermally.

Typical and specific examples of dyes for use in thermal dye sublimation transfer have been described in, e.g., EP 209990, EP 209991, EP 216483, EP 218397, EP 227095, EP 227096, EP 229374, EP 235939, EP 247737, EP 257577, EP 257580, EP 258856, EP 279330, EP 279467, EP 285665, U.S. Pat. Nos. 4,743,582, 4,753,922, 4,753,923, 4,757,046, 4,769,360, 4,771,035, JP 84/78894, JP 84/78895, JP 84/78896, JP 84/227490, JP 84/227948, JP 85/27594, JP 85/30391, JP 85/229787, JP 85/229789, JP 85/229790, JP 85/229791, JP 85/229792, JP 85/229793, JP 85/229795, JP 86/41596, JP 86/268493, JP 86/268494, JP 86/268495 and JP 86/284489.

The dyes may be used as single components to form a monochrome dye image, e.g. yellow, magenta or cyan dye image, or may be used in admixture, e.g. in a combination forming black as described e.g. in U.S. Pat. No. 4,816,435 and unpublished European patent application (EP-A) 90200991.9.

According to an embodiment of the present invention the donor element comprises sequentially repeating areas containing respectively a magenta, yellow and cyan dye and in each of said dye area said benzthiazole type UV-absorbing compound. A donor element of analogous structure is illustrated by FIG. 1 of published EP-A 0 357 363. According to another embodiment said sequentially repeating areas are followed by an additional separate dye-free area containing said UV-absorbing compound.

The donor element containing the UV-absorbing compound(s) may comprise other additives, such as curing agents, preservatives, etc. These and other ingredients are described e.g. in EP 133011, EP 133012, EP 111004 and EP 279467.

Any material can be used as the support for the UV-absorbing compound provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm. The support may also be coated with an adhesive or subbing layer, if desired.

The donor layer containing the UV-absorbing compound may be coated on the support or printed thereon by a printing technique such as a gravure process.

A barrier layer comprising a hydrophilic polymer may also be employed in the donor element between its support and the layer containing the UV-absorbing compound to improve transfer densities by preventing wrong-way transfer of UV-absorbing compound towards the support. In general, good results have been obtained with a barrier layer on the basis of gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable barrier layers have been described in e.g. EP 227091 and EP 228065. Certain hydrophilic polymers, for example those described in EP 227091, also have an adequate adhesion to the support and the donor layer thermally transferring a UV-absorbing compound, thus eliminating the need for a separate adhesive or subbing layer. These particular hydrophilic polymers used in a single layer in the donor element thus perform a dual function, hence are referred to as barrier/subbing layers.

For use in combination with thermal printing heads the reverse side of the donor element is coated preferably with a slipping layer to prevent the printing head from sticking to the dye-donor element. Such a slipping layer comprises a lubricating material. Examples of suitable lubricating materials are a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in e.g. EP 138483, EP 227090, U.S. Pat. No. 4,567,113, 4,572,860, 4,717,711. Preferably the slipping layer comprises as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

The receptor element used in the thermal transfer process according to the present invention may be any receptor element known for thermal dye transfer and normally contains an image-receiving layer on a transparent or opaque sheet or web support.

Suitable transparent supports are resin supports made of e.g. polyethylene terephthalate, a polyether sulfone, a polyimide, a cellulose ester or a polyvinyl alcohol-co-acetal. Suitable opaque supports are opacified resin supports, e.g. coated with a white pigment layer or paper supports optionally coated with a resin layer, e.g. polypropylene layer.

The image-receiving layer capturing the UV-absorbing compound(s) may comprise, for example, a polycarbonate, a polyurethane, a polyester, a polyamide, polyvinyl chloride, polystyrene-co-acrylonitrile, polycaprolactone or mixtures thereof. Suitable image-receiving layers have been described in e.g. EP 133011, EP 133012, EP 144247, EP 227094, EP 228066.

The UV-compound containing layer of the donor element or the therewith associated image-receiving layer of the receiver element may also contain a releasing agent that aids in separating the donor element from the image-receiving element after transfer. The releasing agents can also be applied in a separate layer on at least part of the UV-absorbing compound donor layer or of the image-receiving layer. For the releasing agent solid waxes, fluorine- or phosphate-containing surfactants and silicone oils are used. Suitable releasing agents are described in e.g. EP 133012, JP 85/19138, EP 227092.

According to an embodiment operating with contact heating using a thermal head in the form of pixelwise electrically heated resistor elements the donor layer providing the UV-absorbing compound is placed in face-to-face relation with the image-receiving layer of the receiver element and imagewise heating proceeds from the back of the donor element. The transfer of the UV-absorbing compound is accomplished by heating for about several milliseconds at a temperature of 400° C. Thermal printing heads that can be used for thermal dye transfer and that are equally well applicable in the thermal transfer of UV-absorbing compounds in the process of the present invention are commercially available.

In a particular embodiment of contact heating the support of the donor element providing the UV-absorbing compound is an electrically resistive ribbon consisting of, for example, a multi-layer structure of a carbon loaded polycarbonate coated with a thin aluminum film whereon a binder layer containing the UV-absorbing compound has been applied. Current is injected pulsewise into the resistive ribbon by electrically addressing a print head electrode resulting in highly localized heating of the ribbon beneath the relevant electrode. An advantage of printing speed is obtained by using the resistive ribbon/electrode head technology compared to the thermal head technology where the various elements of the thermal head get hot and must cool down before the head can move to the next printing position.

As an alternative to thermal head or resistive ribbon heating laser light can be used as the heat source for supplying heat energy. In case laser light is used, the donor layer providing the UV-absorbing compound(s) or a layer in heat-conductive relationship therewith has to contain a compound that absorbs the light emitted by the laser and converts it into heat, e.g. carbon black.

The following example illustrates the present invention without however limiting it thereto.

All ratios and percentages are by weight unless otherwise indicated.

EXAMPLE

A series of thermal imaging donor elements for forming an UV-absorbing mask in an image-receiving material were prepared.

Therefor a particular amount of binder as identified below and of an UV-absorbing compound (UVC) of Table 1 were dissolved in methyl ethyl keton (mg per 10 ml) as indicated in Table 2 and coated at a coverage of 0.5 g/m2 of UV-absorbing compound on a 6 μm thick polyethylene terephthalate film. The resulting layer was dried by evaporation of the solvent. Optionally to the coating composition 1,10-decanediol as thermal solvent was added to be coated at a coverage of 300 mg/m$^2$.

The above prepared donor element was used in combination with a commercially available transparent film-type image-receiving material (MITSUBISHI CK100TS) to receive the thermally transferred UV-absorbing compound.

The thermal transfer printing proceeded in a MITSUBISHI CP100E color video printer using the electronic digital information obtained from the monochrome scanning (successively red, green and blue) of a multicolour original intended for reproduction by lithographic printing.

The receiver sheet was separated from the dye-donor element and the UV-density measured with a MACBETH Quanta Log (registered trade mark) densitometer using a KODAK Wratten filter 18A to cut off visible light. The measured maximum density value ($D_{max}$) corresponding with pixel density is listed in the following Table 2.

In said Table 2 binder B1 stands for nitrocellulose with a nitrogen content of 10% and B2 for cellulose acetate butyrate having an acetyl content of 29.5% and a butyryl content of 17%.

TABLE 2

| UV-compound | binder | mg UVC/ mg binder | TS | $D_{max}$ |
|---|---|---|---|---|
| 1 | B1 | 50/20 | none | 2.57 |
| 1 | B2 | 50/50 | none | 2.47 |
| 1 | B2 | 90/100 | present | 2.69 |
| 1 | B2 | 90/50 | present | 2.78 |
| 2 | B1 | 50/20 | none | 2.30 |

TABLE 2-continued

| UV-compound | binder | mg UVC/ mg binder | TS | $D_{max}$ |
|---|---|---|---|---|
| 2 | B2 | 50/50 | none | 1.74 |
| 3 | B1 | 50/20 | none | 1.70 |
| 4 | B2 | 50/50 | none | 1.58 |
| 5 | B2 | 50/50 | none | 1.40 |

We claim:

1. A thermal transfer printing process wherein a donor element for thermal transfer is heated imagewise in contact with a receptor element, said donor element comprising a sheet support having on one side thereof a layer incorporating in a wax or polymeric binder material an UV-absorbing benzthiazole compound corresponding to the following general formula (A):

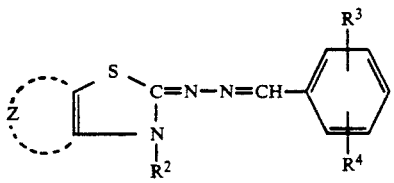

(A)

wherein:

Z represents the atoms necessary to close a benzene ring, $R^2$ represents hydrogen, an alkyl group of 1 to 4 carbon atoms, or an aryl group, each of $R^3$ and $R^4$ (same or different) represents hydrogen, an amino group or an alkoxy group.

2. A process according to claim 1, wherein Z represents the atoms necessary to close an adjacent benzene ring either or not substituted with one or more substituents $R^1$ of the following group: alkyl, alkoxy, halogen, cyano, —COR, —$SO_2$R, —NHCOR, or —$NHSO_2$R, wherein R is alkyl, alkaryl or aryl; —$SO_2$—N($R^{11}$, $R^{12}$), wherein each of $R^{11}$ and $R^{12}$ (same or different) is hydrogen, alkyl, alkaryl or aryl, and —NHP(O)($R^{13}$,$R^{14}$), wherein each of $R^{13}$ and $R^{14}$ (same or different) is hydrogen, alkyl, alkaryl, aryl, alkoxy or an amino group.

3. A process according to claim 2, wherein $R^1$ represents an ethoxy group.

4. A process according to claim 1, wherein $R^2$ represents a methyl group.

5. A process according to claim 1, wherein $R^3$ is hydrogen and $R^4$ is a dimethylamino or diethylamino group.

6. A process according to of claim 1, wherein together with the UV-absorbing compound a dye or dyes is transferred onto the receptor element.

7. A process according to claim 1, wherein together with the UV-absorbing compound a thermal solvent is transferred onto the receptor element.

8. A process according to claim 1, wherein the imagewise heating proceeds with a thermal head comprising pixelwise electrically heated resistor elements.

9. A process according to claim 1, wherein the imagewise heating proceeds with a resistive ribbon structure wherein current is injected pulsewise.

10. A process according to claim 1, wherein the imagewise heating proceeds by imagewise modulated laser beam.

11. A donor element suited for use in a thermal printing process, wherein said donor element comprises a support having on one side thereof a layer including in a binder medium an UV-absorbing compound, and on the other side a slipping layer comprising a lubricant, said UV-absorbing compound corresponding to the following general formula (A):

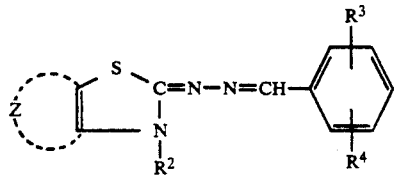

(A)

wherein:

Z represents the atoms necessary to close a benzene ring, $R^2$ represents hydrogen, an alkyl group of 1 to 4 carbon atoms, or an aryl group, each of $R^3$ and $R^4$ (same or different) represents hydrogen, an amino group, or an alkoxy group.

12. A donor element according to claim 11, wherein Z represents the atoms necessary to close an adjacent benzene ring either or not substituted with one or more substituents $R^1$ of the following group: alkyl, alkoxy, halogen, cyano, —COR, —$SO_2$R, —NHCOR, OR —$NHSO_2$R, wherein R is alkyl, alkaryl or aryl; —$SO_2$—N($R^{11}$, $R^{12}$), wherein each of $R^{11}$ and $R^{12}$ (same or different) is hydrogen, alkyl, alkaryl or aryl, and —NHP(O)($R^{13}$,$R^{14}$), wherein each of $R^{13}$ and $R^{14}$ (same or different) is hydrogen, alkyl, alkaryl, aryl, alkoxy or an amino group.

13. A donor element according to claim 12, wherein $R^1$ represents an ethoxy group.

14. A donor element according to claim 11, wherein $R^2$ represents a methyl group.

15. A donor element according to claim 11, wherein $R^3$ is hydrogen and $R^4$ is a dimethylamino or diethylamino group.

16. A donor element according to claim 11, wherein said donor element comprises sequentially repeating areas containing respectively a magenta, yellow and cyan dye and said UV-absorbing compound in each said area or said UV-absorbing compound in an additional separate dye-free area.

* * * * *